US007311616B2

(12) United States Patent
Fujisawa et al.

(10) Patent No.: US 7,311,616 B2
(45) Date of Patent: Dec. 25, 2007

(54) ONE-PIECE GOLF BALL

(75) Inventors: Koichi Fujisawa, Kobe (JP); Kazuhiko Isogawa, Kobe (JP); Yoshikazu Yabuki, Kobe (JP)

(73) Assignee: SRI Sports Limited, Kobe-Shi (JP)

( * ) Notice: Subject to any disclaimer, the term of this patent is extended or adjusted under 35 U.S.C. 154(b) by 245 days.

(21) Appl. No.: 11/043,969

(22) Filed: Jan. 28, 2005

(65) Prior Publication Data

US 2005/0187035 A1 Aug. 25, 2005

(30) Foreign Application Priority Data

Feb. 23, 2004 (JP) ..... 2004-046843

(51) Int. Cl.
*A63B 37/00* (2006.01)

(52) U.S. Cl. ..... 473/351

(58) Field of Classification Search ..... 473/351
See application file for complete search history.

(56) References Cited

U.S. PATENT DOCUMENTS

| | | | | |
|---|---|---|---|---|
| 4,894,092 | A * | 1/1990 | Nishihara et al. | 106/452 |
| 6,706,794 | B1 * | 3/2004 | Tsuda et al. | 524/430 |
| 2002/0193180 | A1 * | 12/2002 | Fujisawa | 473/371 |

FOREIGN PATENT DOCUMENTS

| | | |
|---|---|---|
| JP | 7-51403 A | 2/1995 |
| JP | 3293679 B2 | 6/2002 |

* cited by examiner

*Primary Examiner*—Raeann Trimiew
(74) *Attorney, Agent, or Firm*—Birch, Stewart, Kolasch & Birch, LLP

(57) ABSTRACT

A one-piece golf ball has a golf ball body made of a rubber composition, and the rubber composition contains 0.5 to 10 parts by mass of a titanium oxide relative to 100 parts by mass of a rubber component. The titanium oxide is surface-treated with a treating agent containing a zirconium component. The one-piece golf ball is superior in weatherability, with less or no discoloration or degradation with time.

13 Claims, 1 Drawing Sheet

ONE-PIECE GOLF BALL

BACKGROUND OF THE INVENTION

1. Field of the Invention

The present invention relates to a one-piece golf ball.

2. Description of the Related Art

Usually, a one-piece golf ball is used in a golf range or a like site, and a coat is formed on the golf ball surface for improving external appearance with luster being applied thereto or for protecting a mark or a golf ball body itself. Long-time use of the one-piece golf ball in a golf range may cause discoloration with time by exposure to UV rays (sunlight), wind or rain. Or the coat on the golf ball may be peeled off by repeated exertion of impact to the golf ball or repeated cleaning of the golf ball. Such discoloration or peeling-off of the coat is not desirable because the golf ball having such poor external appearance may give impression that the golf ball is degraded. Further, as a result of actual progress of degradation of a one-piece golf ball body, the golf ball may suffer from crack or a like phenomenon.

Under the aforementioned circumstances, one-piece golf balls with improved weatherability and durability have been proposed. For instance, Japanese Unexamined Patent Publication No. 2002-325864 (hereinafter, called as "D1") discloses a one-piece golf ball which is free of yellowish discoloration with time and can retain its whiteness by addition of titanium oxide and a blue pigment in respective predetermined amounts. Japanese Patent No. 3293679 (hereinafter, called as "D2") discloses a golf ball, wherein titanium oxide, a blue pigment, and a purple pigment are included in respective predetermined amounts in a rubber composition for composing a one-piece golf ball body, and a clear coat is applied onto the golf ball body. Japanese Unexamined Patent Publication No. 7-51403 (hereinafter, called as "D3") proposes a one-piece golf ball constructed such that a golf ball body in which titanium oxide, a blue pigment, and a purple pigment are included in predetermined respective amounts is covered with a clear coat containing an oxidation inhibitor and a light stabilizer.

In the one-piece golf ball disclosed in D1, an attempt is made to retain whiteness of the golf ball by increasing the degree of a blue color component in the golf ball body, based on a complementary color relation between blue and yellow, while overcoming degradation of the rubber component of the golf ball body by exposure to UV rays or the like, which may cause yellowish discoloration. The art disclosed in D1 has a limitation in that degradation of the rubber component itself is not suppressed. Accordingly, despite an effort of retaining whiteness, crack may occur in the golf ball by exertion of an impact or a like external force to the golf ball, once degradation of the rubber component progresses. Further, if yellowish discoloration outranges the degree of the blue color component, as a result of progress of degradation of the rubber component, the golf ball cannot retain its whiteness.

Further, it is a general practice to use an organic stabilizer such as an oxidation inhibitor or a UV absorbent, as an ingredient of a coat to be applied on the conventional one-piece golf ball as disclosed in D3. Since such an organic stabilizer decomposes by itself by hydrolysis or attacking of radicals generated by UV rays, the anti-oxidizing or UV absorbing performance cannot be sustained for a long time. If the action of the organic stabilizer ceases or is weakened, it is highly likely that a base resin of the coat may be decomposed by exposure to UV rays, or the degraded coat may be peeled off from the surface of the golf ball body. As a result, the coat may no longer protect the golf ball body, and discoloration or crack may occur by degradation of the rubber component of the golf ball body due to exposure to UV rays, wind, or rain.

D2 utilizes rutile type titanium oxide in an attempt to improve weatherability. Titanium oxide degrades the rubber composition of a one-piece golf ball body by photocatalytic action of the titanium oxide, despite a merit that the titanium oxide acts as a UV absorbent, and contributes to improvement of weatherability.

Specifically, by exposure to UV rays, an electron-hole pair consisting of a free electron ($e^-$) on a conduction band and a positive hole ($p^+$) on a valance electron band is generated in the titanium oxide due to excitation of the electron on the valance electron band, as represented by the following formula (1).

$$TiO_2+h_\nu \rightarrow p^+ + e^- \quad (1)$$

The positive hole ($p^+$) is entrapped by $OH^-$ in adsorbed water on the surface of the titanium oxide, thereby generating an OH free radical, as represented by the formula (3). The generated free radical decomposes a rubber component by its powerful oxidizing action.

$$H_2O \rightarrow H^+ + OH^- \quad (2)$$

$$OH^- + p^+ \rightarrow \dot{O}H \quad (3)$$

The free electron ($e^-$) reduces $Ti^{4+}$ in a crystal of the titanium oxide to $Ti^{3+}$ as represented by the formula (4). Subsequently, $O_2$ in the air is adsorbed to the $Ti^{3+}$, and turns to $O^-_2$ as represented by the formula (5). Then, the $O^-_2$ is reacted with the $H^+$ in the formula (2), and turns to an $H\dot{O}_2$ free radical while undergoing the reaction as represented by the formula (6). Similarly to the $\dot{O}H$ free radical, the $H\dot{O}_2$ free radical decomposes the rubber component around the titanium oxide by its powerful oxidizing action.

$$[Ti^{4+}]+e^- \rightarrow [Ti^{3+}] \quad (4)$$

$$[Ti^{3+}]+O_2 \rightarrow [Ti^{4+}]+O^-_2 \quad (5)$$

$$O^-_2+H^+ \rightarrow H\dot{O}_2 \quad (6)$$

The above photocatalytic action may occur even in use of rutile type titanium oxide. Further, there is a drawback that weatherability of the golf ball body cannot be improved sufficiently, as far as the cover composition contains titanium oxide, despite inclusion of a color stabilizer such as a UV absorber and a light stabilizer, as disclosed in D3.

SUMMARY OF THE INVENTION

In view of the problems residing in the prior art, an object of the present invention is to provide a one-piece golf ball that is less likely to cause discoloration or degradation with time, and has superior weatherability, durability against crack, and coat adhesiveness.

According to an aspect of the present invention, a one-piece golf ball comprises a golf ball body made of a rubber composition, and the rubber composition contains 0.5 to 10 parts by mass of a titanium oxide relative to 100 parts by mass of a rubber component. The titanium oxide is surface-treated with a treating agent containing at least a zirconium component.

These and other objects, features and advantages of the present invention will become more apparent upon reading of the following detailed description along with the accompanying drawings.

DETAILED DESCRIPTION OF THE PREFERRED EMBODIMENTS OF THE INVENTION

Figure 1A:
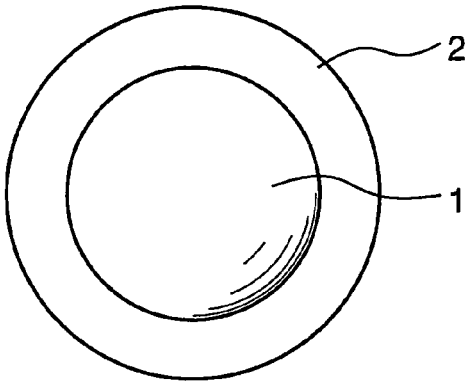
FIGS. 1A and 1B are illustrations showing examples of surface-treated titanium oxide particles.

A one-piece golf ball according to an embodiment of the present invention comprises a golf ball body made of a rubber composition, and the rubber composition contains 0.5 to 10 parts by mass of a titanium oxide which is surface-treated with a treating agent containing at least a zirconium component relative to 100 parts by mass of a rubber component. First, the titanium oxide (hereinafter, called as "surface-treated titanium oxide") which is surface-treated with a treating agent containing at least a zirconium component is described.

An aqueous solution containing at least a zirconium component can be used as the treating agent. Examples of the aqueous solution are an aqueous solution containing a water-soluble zirconium compound, such as zirconium sulfate, zirconium chloride, or zirconium nitrate. The aqueous solution can be used with an aqueous solution containing a water-soluble silicon compound such as sodium silicate or potassium silicate, or with an aqueous solution containing a water-soluble tin compound such as tin chloride, or with an aqueous solution containing a water-soluble aluminum compound such as aluminum sulfate or sodium aluminate.

The surface-treated titanium oxide used in the embodiment of the present invention can be obtained as follows, for instance. The treating agent is gradually added to an aqueous slurry of titanium oxide of a predetermined temperature for neutralization, while maintaining the pH of the slurry constant, thereby depositing the component contained in the treating agent as an oxide or a hydrate thereof on the surface of the titanium oxide, and letting it aged. In the case of depositing different kinds of components in the treating agent on the surface of the titanium oxide, the aforementioned operation is repeated with an aqueous slurry containing other component(s). After depositing the desired component(s), the titanium oxide with the desired component(s) being deposited on the surface thereof is rinsed with water, filtrated, and dried, followed by pulverization to thereby obtain a surface-treated titanium oxide.

As far as the surface-treated titanium oxide is the one whose surface has been treated with the treating agent containing at least a zirconium component, the ingredients of the treating agent are not specifically limited. For instance, the treating agent may preferably contain, in addition to a zirconium component, various components including at least one element such as aluminum, silicon, zinc, tin, antimony, and cerium. It is preferable to use a surface-treated titanium oxide which has been surface-treated with a treating agent containing a zirconium component and one or more components including at least one element selected from the group consisting of aluminum, silicon, tin, and cerium. A most preferred surface-treated titanium oxide is the one which has been surface-treated with a treating agent containing a zirconium component, an aluminum component, and a silicon component in light of a merit that such surface-treated titanium oxide is advantageous in improving weatherability. It is preferred to use a surface-treated titanium oxide with the aforementioned component(s) being deposited as an oxide or a hydrate thereof on the surface of the titanium oxide particle.

Figure 1B:
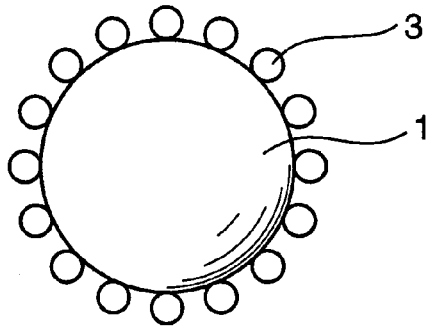

Examples of the surface-treated titanium oxide are the one (see FIG. 1A) in which a surface-treated layer 2 containing the above component(s) is formed on the surface of a titanium oxide particle 1, and the one (see FIG. 1B) in which fine particles 3 containing the above component(s) are adhered on the surface of the titanium oxide. Both of the surface-treated titanium oxides which have been treated with a surface treatment at a content capable of suppressing photocatalytic action of the titanium oxide are applicable because both of the surface-treated titanium oxide provide a resultant golf ball with an improved weatherability for the following reasons.

As mentioned above, an OH free radical generated by exposure of the titanium oxide to UV rays has a powerful oxidizing action. The OH free radical is unstable, has a short life, and decomposes as represented by the following formula (7).

$$2\dot{O}H \rightarrow H_2O + O_2 \quad (7)$$

If the aforementioned component(s), an oxide or a hydrate thereof is formed on the surface of the titanium oxide, the decomposition as represented by the formula (7) is progressed by a catalytic action of the oxide or the like while the OH free radicals pass through the layers of the component(s), the oxide, or the hydrate thereof. As a result, the quantity of free radicals involved in oxidative decomposition of the rubber component is reduced, which resultantly suppresses degradation of the rubber component.

Further, the above component is used to provide the titanium oxide with light stability. Use of the component also contributes to suppression of the photocatalytic action of the titanium oxide. As a result, weatherability of the rubber component composing the golf ball body is improved.

In the embodiment of the present invention, it is preferable to use a surface-treated titanium oxide that has been surface-treated with a treating agent containing a silicon component and an aluminum component, in addition to a zirconium component. Examples of the surface-treated titanium oxide include "D-918" (surface treatment with $SiO_2.H_2O$, $SrO_2.H_2O$, $Al_2O_3.H_2O$), "R-61N" (surface treatment with $ZrO_2.Al_2O_3$), and "STR60S" (surface treatment with Ce/Sn/Zn/Al). All the products under the above trade names are produced by Sakai Chemical Industry Co., Ltd. Among these, the product "D-918" is preferred.

The rubber composition of the inventive one-piece golf ball contains 0.5 part by mass or more, preferably 1 part by mass or more, and more preferably 2 parts by mass or more of the surface-treated titanium oxide relative to 100 parts by mass of the rubber component. The titanium oxide has an effect of absorbing UV rays, in addition to a function as a white pigment. As mentioned above, degradation with time such as crack and discoloration occurs in the golf ball body by decomposition of the rubber component composing the golf ball body due to exposure to sunlight, particularly, UV rays. In view of this, decomposition of the rubber component or discoloration of the golf ball body can be prevented by decreasing the quantity of UV rays which may act on the rubber component by addition of the surface-treated titanium oxide.

Further, although the reason has not been elucidated, addition of the surface-treated titanium oxide enables to improve performance of the golf ball in long-time use, because durability against crack in use, and adhesiveness of a coat, which will be described later, are improved. In the case where the content of the surface-treated titanium oxide is lower than the aforementioned lower limit, merits such as improvements in weatherability, durability against crack, and coat adhesiveness are unlikely to be obtained. Further, the rubber composition contains 10 parts by mass or less, preferably, 8 parts by mass or less, and more preferably, 5 parts by mass or less of the surface-treated titanium oxide relative to 100 parts by mass of the rubber component. If the content of the surface-treated titanium oxide exceeds the above upper limit, the content of the inorganic component in the rubber composition undesirably increases, with the result that crack is liable to occur. Further, since the titanium oxide is a material having a relatively large specific gravity, an excessive inclusion of the surface-treated titanium oxide may undesirably increase the weight of the golf ball.

It is preferable to disperse particles of the surface-treated titanium oxide in the rubber composition to allow the surface-treated titanium oxide to exhibit the function as a white pigment, and to effectively exhibit the UV absorbability.

As far as the rubber composition contains 0.5 to 10 parts by mass of the surface-treated titanium oxide relative to 100 parts by mass of the rubber component, the ingredients of the rubber composition are not specifically limited. For instance, the rubber composition may contain a rubber component, a surface-treated titanium oxide, α,β-unsaturated carboxylic acid and/or a metal salt thereof, an organic peroxide, a pigment, and a filler. Even in such a rubber composition, it is preferable that the rubber composition contains 0.5 to 10 parts by mass of the surface-treated titanium oxide relative to 100 parts by mass of the rubber component.

Examples of the rubber component are butadiene rubber (BR), three-component copolymer of ethylene/propylene/diene (EPDM), isoprene rubber (IR), butyl rubber (IIR), natural rubber (NR), nitrile rubber (NBR), and styrene rubber (SBR). These rubber components may be used alone or in combination of two or more kinds thereof. Among these, it is preferred to use butadiene as a primary ingredient of the rubber component. A preferred example is the one containing 50 parts by mass or more of butadiene rubber relative to 100 parts by mass of a base rubber. High cis polybutadiene containing 90% or more of cis-1,4 bonds, for example, BR-11 manufactured by JSR Corporation is preferable as such a butadiene rubber.

The α,β-unsaturated carboxylic acid and/or a metal salt thereof is used as a co-crosslinking agent. It is preferable to add 15 parts by mass or more, and more preferably, 18 parts by mass or more, and 45 parts by mass or less, and more preferably, 38 parts by mass or less of the co-crosslinking agent relative to 100 parts by mass of the rubber component. If the content of the co-crosslinking agent is lower than the lower limit, the resultant golf ball may become too soft to thereby increase deformation of the golf ball at hitting. For instance, if a coat is applied onto the surface of a one-piece golf ball body having such a softness, adhesiveness of the coat may be lowered. On the other hand, if the content of the co-crosslinking agent exceeds the upper limit, the resultant golf ball may have an excessive hardness, thereby giving poor shot feeling to a golfer.

Examples of the α,β-unsaturated carboxylic acid and/or a metal salt thereof are α,β-unsaturated carboxylic acid having 3 to 8 carbon atoms, and/or a metal salt thereof. Preferred examples are acrylic acid, methacrylic acid, zinc acrylate, and zinc methacrylate. Particularly, it is preferred to use a metal salt such as a zinc salt or a magnesium salt to enhance repulsion performance of a golf ball.

The organic peroxide is added to crosslink the rubber components. It is desirable to use 0.3 part by mass or more, and preferably 0.5 part by mass or more, and 5 parts by mass or less, and preferably 3 parts by mass or less of the organic peroxide relative to 100 parts by mass of the rubber component. Examples of the organic peroxide are dicumylperoxide, 1,1-bis(t-butylperoxy)-3,5-trimethylcyclohexane, 2,5-dimethyl-2,5-di(t-butylperoxy)hexane, di-t-butylperoxide. Among these, dicumylperoxide is preferred.

Examples of the pigment to be included in the rubber composition are a blue pigment and a purple pigment, in addition to the titanium oxide, which is a white pigment. The blue pigment is added to brighten the whiteness of a golf ball. Examples of the blue pigment are ultramarine, cobalt blue, and phthalocyanine blue. It is desirable to use 0.001 part by mass or more, and preferably 0.05 part by mass or more, and 0.2 part by mass or less, and preferably 0.1 part by mass of the blue pigment relative to 100 parts by mass of the rubber component. If the content of the blue pigment is lower than 0.001 part by mass, sufficient blue color is not imparted to a resultant golf ball, thereby making the golf ball look yellowish. On the other hand, if the content of the blue pigment exceeds 0.2 part by mass, a resultant golf ball exhibits too strong blue color, with the result that bright whiteness is impaired.

Examples of the purple pigment are anthraquinone violet, dioxazine violet, and methyl violet.

The filler to be included in the rubber composition is used to adjust a specific gravity of the rubber composition. For instance, the content of the filler is 15 parts by mass or more, preferably, 20 parts by mass or more, and 40 parts by mass or less, and preferably 30 parts by mass or less relative to 100 parts by mass of the rubber component. Examples of the filler are zinc oxide, silica, calcium carbonate, and barium sulfate. Among these, zinc oxide and barium sulfate are preferred.

The rubber composition to be used in the embodiment of the present invention may contain an oxidation inhibitor, an antioxidant, and a softener.

The golf ball body of the inventive one-piece golf ball is produced by hot forming the rubber composition. The hot forming conditions of the rubber composition may be optionally determined depending on the rubber composition. Normally, it is preferred to heat the rubber composition in one stage: heating at a temperature from 130 to 200° C. for 10 to 60 minutes, or in two stages: heating at a temperature from 130 to 150° C. for 20 to 40 minutes, followed by heating at a temperature from 160 to 180° C. for 5 to 15 minutes. Normally, recesses called dimples are formed on the surface of the golf ball body. Further, it is preferable to perform a grinding process such as a sandblast process onto the golf ball body surface so as to improve coat adhesiveness, which will be described later.

Preferably, the inventive one-piece golf ball may have a coat for covering the golf ball body produced by hot forming the rubber composition. A well-known resin usable as a coating component for a golf ball can be used as a resin component to be contained in the coat. Preferred examples of the coating component are acrylic resin, epoxy resin, urethane resin, polyester resin, and cellulose resin, and a 2-pack type curable urethane resin, which will be described later. Use of the 2-pack type curable urethane resin as a resin component enables to produce a coat superior in wear resistance.

The 2-pack type curable urethane resin is a urethane resin produced by reacting a base resin with a curing agent for curing. Examples of the 2-pack type curable urethane resin are the one produced by curing a base resin containing an isocyanate-group-terminated urethane prepolymer with a curing agent containing active hydrogen atoms, or the one produced by curing a base resin containing a polyol component with polyisocyanate or a derivative thereof.

In the embodiment of the present invention, it is particularly preferred to use, as a resin component of the coat, the 2-pack type curable urethane resin which is produced by curing the base resin containing a polyol component with the curing agent such as polyisocyanate or a derivative thereof. This is because the curing agent such as polyisocyanate or a derivative thereof improves adhesiveness of the coat to the golf ball body surface by reaction with the rubber component, the additive component or a like component composing the golf ball body.

It is preferred to use the urethane polyols as defined below, as the base resin containing a polyol component. The kind of the urethane polyol is not specifically limited, as far as the urethane polyol is polyol having a urethane bond, and at least 2 hydroxyl groups (preferably, at a terminal thereof). Such urethane polyol is obtained by reacting polyol with polyisocyanate in such an amount that hydroxyl groups in the polyol component are excessively relative to isocyanate groups in the polyisocyanate in molar ratio.

The kind of the polyisocyanate for constituting the urethane polyol is not specifically limited, as far as the polyisocyanate has at least 2 isocyanate groups. Examples of the polyisocyanate are aromatic polyisocyanates such as 2,4-toluene diisocyanate, 2,6-toluene diisocyanate, a mixture (TDI) of 2,4-toluene diisocyanate and 2,6-toluene diisocyanate, 4,4'-diphenylmethane diisocyanate (MDI), 1,5-naphthylene diisocyanate (NDI), 3,3'-bitolylene-4,4-diisocyanate (TODI), xylene diisocyanate (XDI), tetramethylxylene diisocyanate (TMXDI), paraphenylene diisocyanate (PPDI); and alicyclic polyisocyanate, aliphatic polyisocyanate or a like polyisocyanate such as 4,4-dicyclohexylmethane diisocyanate ($H_{12}$MDI), hydrogenated xylene diisocyanate ($H_6$XDI), hexamethylene diisocyanate (HDI), and isophorone diisocyanate (IPDI) in one or more kinds thereof. Among these, discoloration-free polyisocyanates (e.g., TMXDI, XDI, HDI, $H_6$XDI, IPDI, and $H_{12}$MDI) are preferred in the aspect of weatherability. The aforementioned polyisocyanates can be used as a curing agent for curing urethane polyol.

The kind of the polyol to be used in producing the urethane polyol is not specifically limited, as far as the polyol has plural hydroxyl groups. Examples of the polyol are a polyol having a low molecular weight, and a polyol having a large molecular weight. Examples of the polyol having a low molecular weight include diols such as ethylene glycol, diethylene glycol, triethylene glycol, 1,3-butanediol, 1,4-butanediol, neopentyl glycol, and 1,6-hexanediol; and triols such as glycerin, trimethylolpropane, and hexanetriol.

Examples of the polyol having a large molecular weight are polyether polyols such as polyoxyethylene glycol (PEG), polyoxypropylene glycol (PPG), and polyoxytetramethylene glycol (PTMG); condensed polyester polyols such as polyethylene adipate (PEA), polybutylene adipate (PBA), and polyhexamethylene adipate (PHMA); lactone polyester polyols such as poly-ε-caprolactone (PCL); polycarbonate polyols such as polyhexamethylene carbonate; and acrylic polyol. Among these polyols, preferred are polyols having a weight-average molecular weight from 50 to 2,000, and particularly preferred are polyols having a weight-average molecular weight from about 100 to 1,000. One or more than one of these polyols may be mixed.

It is preferred that the ratio of urethane bond in the urethane polyol is not lower than 0.1 mmol and not higher than 5 mmol relative to 1 g of the urethane polyol. The ratio of urethane bond has a close relation to stiffness of the coat to be formed. If the ratio of urethane bond is less than 0.1 mmol/g, the urethane bond concentration in the coat is exceedingly lowered, thereby failing to provide a resultant golf ball with sufficient abrasion resistance. On the other hand, if the ratio of urethane bond exceeds 5 mmol/g, the coat is likely to have an excessive hardness.

The weight-average molecular weight of the urethane polyol is 4,000 or larger, and preferably, 4,500 or larger, and 10,000 or smaller, and preferably 9,000 or smaller. If the weight-average molecular weight of the urethane polyol is smaller than 4,000, it takes a longer time in drying, thereby lowering workability and productivity. On the other hand, the weight-average molecular weight of the urethane polyol is larger than 10,000, the hydroxyl group value of the urethane polyol is relatively small, and the amount of hydroxyl groups to be reacted with the curing agent after application of the coat is reduced, which may lower coat adhesiveness to the golf ball body. If the weight-average molecular weight of the urethane polyol is 9,000 or less, a fine coat with less or no likelihood of adhesiveness lowering even in contact with moisture is formable.

The hydroxyl group value (mgKOH/g) of the urethane polyol is 15 or more, preferably 73 or more, and 130 or less, and preferably 120 or less. If the hydroxyl group value of the urethane polyol is less than 15 (mgKOH/g), the amount of hydroxyl groups to be reacted with the curing agent is insufficient, with the result that coat adhesiveness to the golf ball body may be lowered. On the other hand, if the hydroxyl group value of the urethane polyol is larger than 130 (mgKOH/g), it takes a longer time in reaction with the curing agent, which resultantly extends a drying time, and lowers productivity of golf balls.

The urethane polyol is obtained by reacting the polyol with polyisocyanate. A solvent or a known catalyst (e.g., dibutyl tin dilaurylate) for use in producing polyurethane is usable in reaction of the polyol with polyisocyanate. The ratio of urethane bond can be determined by regulating the molecular weight of a raw material polyol, a mixing ratio of polyol to polyisocyanate, or the like.

Preferably, the base resin containing the polyol component substantially contains the aforementioned urethane polyol exclusively. In other words, it is preferred to use the aforementioned specific urethane polyol substantially exclusively, as the base resin containing the polyol component. Alternatively, the base resin may contain polyol that is compatible to urethane polyol and does not have a urethane bond, other than the aforementioned urethane polyol. The kind of the polyol that does not have a urethane bond is not specifically limited, and a raw material polyol for synthesizing the aforementioned urethane polyol may be used. In the case where the base resin contains polyol that does not have a urethane bond, preferably, the content of the urethane polyol to the base resin is 50% by mass or more, and more preferably, 80% by mass or more. If the content of the urethane polyol to the base resin is less than 50% by mass, the content of the urethane polyol to the base resin is relatively small, thereby extending a drying time.

The coat to be formed on the inventive one-piece golf ball may contain an additive capable of being included in the coat such as an organic UV absorber, an oxidation inhibitor, a light stabilizer, a fluorescent whitening agent, a blocking inhibitor, and a pigment, in addition to the resin component. Preferably, the coat is a clear coat substantially free of a pigment.

The coat can be formed on a golf ball body surface by applying a coating composition containing a solvent, an additive, or the like onto the golf ball body surface, and drying the coating composition. The coat may be a single layer or a multilayer. Preferably, the coat is a single layer in view of a fact that the coat of the single layer exhibits sufficient coating performance, because the inventive coat has superior adhesiveness to the golf ball body surface, and durability.

The thickness of the coat is not specifically limited, but preferably in the range from 5 to 20 μm. If the thickness is less than 5 μm, sufficient coating performance is not obtainable. On the other hand, if the thickness is larger than 20 μm, the sizes of the dimples may be varied from each other, which may like to degrade flight performance of a resultant golf ball.

EXAMPLES

In the following, the present invention is illustrated in detail with Examples, which however, do not limit the invention. Adequate modification is allowable as far as it does not depart from the object of the present invention described above or below, and every such modification is intended to be embraced in the technical scope of the present invention.

[Evaluation Method]

(1) Weatherability

A weatherability test was conducted by irradiation of light onto golf balls for 60 hours in a chamber of a temperature at 63° C., humidity of 50%, with showers of rain for 12 minutes in every 60 minutes, using a Sunshine Super Long Life Weather Meter "WEL-SUN-HC/B" manufactured by Suga Test Instruments Co., Ltd. The color tone (L value, a value, b value) of each golf ball at the same position before and after the irradiation was measured with use of a colorimeter "CR-221" manufactured by Konica Minolta Co., Ltd. Differences in L value, a value, and b value (namely, ΔL, Δa, Δb) between before and after the irradiation were obtained, and ΔE was calculated by implementing the following equation. The value ΔE represents a degree of discoloration. The larger the ΔE is, the greater the degree of discoloration is.

$$\Delta E=[(\Delta L)^2+(\Delta a)^2+(\Delta b)^2]^{1/2}$$

(2) Durability of Golf Ball Against Crack

The number of hitting of each golf ball until the golf balls cracked was measured by attaching a metal head driver W#1 to a swing robot manufactured by True Temper, Co., and causing the robot to hit each golf ball at a head speed of 45 m/sec against a collision board. Durability of golf ball against crack was determined by measuring the number of hitting until each golf ball was cracked, and was represented as an index of the number of hitting of each golf ball, with the number of hitting of the golf ball No. 6 (=100). The larger the index is, the more superior the durability of the golf ball against crack is.

(3) Golf Ball Deformation (mm)

Deformation of each golf ball in a compressing direction was measured when a load ranging from 98 N (10 kgf) as an initial load to 1274 N (130 kgf) as a final load was applied to the golf ball.

(4) Coat Adhesiveness

The coat adhesiveness was evaluated according to the following criteria by observing peeled states of the respective coats of the golf balls by attaching a driver to a swing robot manufactured by True Temper, Co., and causing the robot to hit each golf ball at a head speed of 40 m/sec 100 times, and by calculating a sum of peeled areas of each coat through a microscope or a like device. The golf balls after the evaluation on weatherability were used for evaluation of the coat adhesiveness.

Evaluation Criteria:

○: no peeling was observed.

Δ: the sum of the peeled areas was smaller than 5 $mm^2$.

x: the sum of the peeled area was not smaller than 5 $m^2$.

[Production of One-Piece Golf Ball Body]

One-piece golf ball bodies each was obtained by kneading the rubber composition as shown in Table 1, and hot forming the rubber composition at a temperature of 160° C. for 30 minutes. The raw materials of the rubber composition shown in Table 1 are as follows:

The polybutadiene rubber is "BR11" manufactured by JSR Corporation;

The blue pigment is "blue 5T015" manufactured by Sumika Color Co., Ltd.;

The surface-treated titanium oxide-1 is "D918" (surface-treatment: $SiO_2.H_2O/ZrO_2.H_2O/Al_2O_3.H_2O$) manufactured by Sakai Chemical Industry Co., Ltd.;

The surface-treated titanium oxide-2 is "R-61N" (surface-treatment: $ZrO_2$ $.Al_2O_3$) manufactured by Sakai Chemical Industry Co., Ltd.;

The surface-treated titanium oxide-3 is "STR-60S" (surface-treatment: Ce/Sn/Zr/Al) manufactured by Sakai Chemical Industry Co., Ltd.;

The surface-untreated titanium oxide is "Tipaque CR-60" manufactured by Ishihara Sangyo Kaisha, Ltd.; and The inorganic UV absorbent is "Ceriguard SC4060" (agent in which cerium oxide particles are covered with amorphous silica, content of cerium oxide: 38.5% by mass, content of silica: 57% by mass) manufactured by Nippon Denko Co., Ltd.

[Formation of Mark and Coat]

A mark "X" of 8 mm in width, 8 mm in height, and 2 mm in line width was printed on the surface of each golf ball body by pad stamping with use of the ink composition for printing mark, as shown in Table 2. Thereafter, a coating composition as prepared in the following manner was sprayed onto each golf ball body surface with an air gun, followed by drying at 40° C. Thus, one-piece golf balls each having the mark and the clear coat (thickness: 10 μm) on the golf ball body surface were produced.

[Preparation of Coating Composition]

(1) Base resin: preparation of urethane polyol 116 parts by mass of PTMG650 (polyoxytetramethylene glycol having a molecular weight of 650 manufactured by Hodogaya Kagaku Kogyo Kabushiki Kaisha), and 16 parts by mass of 1,2,6-hexanetriol were dissolved in 120 parts by mass of a solvent (mixture of toluene and methylketone), with addition of dibutyl tin dilaurylate, so that the content of dibutyl tin dilaurylate was 0.1% by mass relative to the total content of the base resin. Then, 48 parts by mass of isophorone diisocyanate was added dropwise in the solution while retaining the solution at a temperature of 80° C. Thus, urethane polyol (solid content: 60% by mass, hydroxyl group value: 87 mgKOH/g, molecular weight: 7,850) was prepared.

The results on evaluation regarding weatherability, coat adhesiveness, and durability against crack with respect to each one-piece golf ball are shown in Table 1.

TABLE 1

| | | Golf ball No. | | | | | | | | |
|---|---|---|---|---|---|---|---|---|---|---|
| | | 1 | 2 | 3 | 4 | 5 | 6 | 7 | 8 | 9 |
| Rubber composition (mass part) | | | | | | | | | | |
| polybutadiene | | 100 | 100 | 100 | 100 | 100 | 100 | 100 | 100 | 100 |
| zinc oxide | | 23.5 | 23.5 | 23.5 | 23.5 | 23.5 | 23.5 | 23.5 | 23.5 | 23.5 |
| methacrylic acid | | 24 | 24 | 24 | 24 | 24 | 24 | 24 | 24 | 24 |
| dicumyl peroxide | | 0.6 | 0.6 | 0.6 | 0.6 | 0.6 | 0.6 | 0.6 | 0.6 | 0.6 |
| blue pigment | | 0.05 | 0.05 | 0.05 | 0.05 | 0.05 | 0.05 | 0.05 | 0.05 | 0.05 |
| surface-treated titanium oxide-1 | | 1.0 | 3.0 | 8.0 | — | — | — | — | — | — |
| surface-treated titanium oxide-2 | | — | — | — | 3.0 | — | — | 0.3 | 13.0 | — |
| surface-treated titanium oxide-3 | | — | — | — | — | 3.0 | — | — | — | — |
| surface-untreated titanium oxide | | — | — | — | — | — | 1.0 | — | — | 1.0 |
| Ceriguard SC-4060 | | — | — | — | — | — | — | — | — | 7.8 |
| Coating composition (mass part) | | | | | | | | | | |
| urethane resin | | 100 | 100 | 100 | 100 | 100 | 100 | 100 | 100 | 100 |
| light stabilizer | | 2 | 2 | 2 | 2 | 2 | 2 | 2 | 2 | 2 |
| UV absorber | | 2 | 2 | 2 | 2 | 2 | 2 | 2 | 2 | 2 |
| fluorescent whitening agent | | 0.2 | 0.2 | 0.2 | 0.2 | 0.2 | 0.2 | 0.2 | 0.2 | 0.2 |
| Ceriguard SC-4060 | | — | — | — | — | — | — | — | — | 7.8 |
| Weatherability | | | | | | | | | | |
| before irradiation | L | 89.6 | 89.6 | 89.7 | 89.8 | 89.7 | 89.7 | 89.5 | 90.2 | 89.6 |
| | a | −0.7 | −0.6 | −0.6 | −0.6 | −0.6 | −0.7 | −0.6 | −0.6 | −0.6 |
| | b | −6 | −6.1 | −6.4 | −6.1 | −6.2 | −6.4 | −6.2 | −6.2 | −6.2 |
| after irradiation | L | 88.6 | 88.8 | 88.9 | 88.7 | 88.7 | 88.1 | 88.6 | 89.4 | 88.8 |
| | a | −1.9 | −2 | −1.7 | −2.1 | −2 | −2.4 | −2 | −2.1 | −1.8 |
| | b | −1.0 | −1.9 | −2.9 | −1.8 | −1.7 | 0.6 | 0.5 | −3.7 | −0.8 |
| | ΔE | 5.2 | 4.5 | 3.8 | 4.7 | 4.8 | 7.4 | 6.9 | 3.0 | 5.6 |
| Ball property | | | | | | | | | | |
| compression deformation (mm) | | 2.6 | 2.5 | 2.5 | 2.5 | 2.5 | 2.6 | 2.6 | 2.5 | 2.5 |
| crack dusrability | | 104 | 116 | 107 | 113 | 112 | 100 | 100 | 96 | 115 |
| coat adhesiveness | | Δ | Δ | ○ | Δ | Δ | X | X | ○ | Δ |

(2) Curing agent: hexamethylene diisocyanate (manufactured by Sumitomo Bayer Urethane Co., Ltd.)

(3) Mixing ratio: NCO in curing agent to OH in hexamethylene diisocyanate=1.2 (in molar ratio)

(4) Coat composition: The coating composition was prepared by admixing the following inorganic UV absorbent, organic UV absorbent, light stabilizer, and fluorescent whitening agent to the 2-pack type curable urethane resin as a resin component. The respective contents of the inorganic UV absorbent, the organic UV absorbent, the light stabilizer, and the fluorescent whitening agent relative to 100 parts by mass of the urethane resin component are shown in Table 1.

The inorganic UV absorbent is "Ceriguard SC4060" (agent in which cerium oxide particles are covered with amorphous silica, content of cerium oxide: 38.5% by mass, content of silica: 57% by mass) manufactured by Nippon Denko Co., Ltd.;

The organic UV absorbent is "Tinuvin 900" manufactured by Ciba Geigy Corp.;

The light stabilizer is "Sanol LS770" (bis(2,2,6,6-tetramethyl-4-piperidyl)sebacate) manufactured by Sankyo Lifetech Co., Ltd.; and The fluorescent whitening agent is "Uvitex OB" manufactured by Ciba Geigy Corp.

TABLE 2

| Ink composition for printing mark | Content (mass part) |
|---|---|
| nitrocellulose resin | 16.8 |
| polyester polyol | 4.2 |
| pigment (carbon black) | 9 |
| deglosser | 14 |
| solvent | 49 |
| curing agent: hexamethylene diisocyanate | 7 |

Golf ball Nos. 1 through 5 each is constructed such that the rubber composition composing the golf ball body contains the surface-treated titanium oxide. All the golf ball Nos. 1 through 5 exhibit superior weatherability and durability against crack. Particularly, the results on golf ball Nos. 1 through 3 exhibit that an increase of the content of the surface-treated titanium oxide decreases ΔE and contributes to improvement of weatherability of the golf ball. Further, the results clarify that the increase of the content of the surface-treated titanium oxide contributes to improvement of coat adhesiveness. A smaller value of ΔE means high sustainability in weatherability by addition of the surface-treated titanium oxide. Golf ball No. 6 is an example in which the surface-untreated titanium oxide is used. ΔE of Golf ball No. 6 was as large as 7.4, and weatherability thereof was remarkably low. Golf ball No. 7 is an example in which the content of the surface-treated titanium oxide is exceedingly low. ΔE of Golf ball No. 7 was as large as 6.9, and weatherability thereof was low. Golf Ball No. 8 is an example in which the content of the surface-treated titanium oxide is exceedingly large. Golf ball No. 8 retained its whiteness after the weatherability test, with superior coat adhesiveness, but showed degradation in durability against crack due to the excessive inclusion of the surface-treated titanium oxide. Golf ball No. 9 is an example in which the inorganic UV absorbent is added, in addition to the surface-untreated titanium oxide. ΔE of Golf ball No. 9 was as large as 5.6, and weatherability thereof was low, as compared with the examples in which the surface-treated titanium oxide was used.

As described above, discoloration of the golf ball body or generation of crack arising from photocatalytic action of the titanium oxide can be suppressed by addition of the titanium oxide that has been surface-treated with the treating agent containing at least a zirconium component. Further, UV absorbing effect of the titanium oxide can be effectively obtained by setting the ratio of the rubber composition as defined above.

Thus, the one-piece golf ball with improved weatherability, durability against crack, and coat adhesiveness can be obtained by inclusion of the surface-treated titanium oxide which has been surface-treated with the treating agent containing a zirconium component in the one-piece golf ball body.

This application is based on Japanese Patent Application No. 2004-046843 filed on Feb. 23, 2004 the contents of which are hereby incorporated by reference.

Although the present invention has been fully described by way of example with reference to the accompanying drawings, it is to be understood that various changes and modifications will be apparent to those skilled in the art. Therefore, unless otherwise such changes and modifications depart from the scope of the present invention hereinafter defined, they should be construed as being included therein.

What is claimed is:

1. A one-piece golf ball comprising a golf ball body made of a rubber composition, the rubber composition containing 0.5 to 10 parts by mass of a titanium oxide relative to 100 parts by mass of a rubber component, the titanium oxide being surface-treated with a treating agent containing a zirconium component and one or more components including at least one element selected from the group consisting of aluminum, silicon, zinc, tin, antimony, and cerium.

2. The one-piece golf ball according to claim 1, wherein the treating agent contains zirconium oxide.

3. The one-piece golf ball according to claim 1, wherein the treating agent contains zirconium oxide and at least one selected from the group consisting of aluminum oxide and silicon oxide.

4. The one-piece golf ball according to claim 1, wherein the golf ball body is covered with a coat containing a resin component, the resin component including a urethane resin.

5. The one-piece golf ball according to claim 4, wherein the coat is made of a single layer.

6. A one-piece golf ball comprising a golf ball body made of a rubber composition, and a coat for coating the golf ball body, the rubber composition containing 0.5 to 10 parts by mass of a titanium oxide relative to 100 parts by mass of a rubber component, the titanium oxide being surface-treated with a treating agent containing a zirconium component and one or more components including at least one element selected from the group consisting of aluminum, silicon, zinc, tin, antimony, and cerium, the coat containing a resin component including a urethane resin, and the coat being made of a single layer.

7. The one-piece golf ball according to claim 1, wherein the treating agent comprises a zirconium component, an aluminum component and a silicon component.

8. The one-piece golf ball according to claim 7, wherein said aluminum component and silicon component are deposited as an oxide or hydrate thereof on the surface of the titanium oxide particle.

9. The one-piece golf ball according to claim 6, wherein the treating agent comprises a zirconium component, an aluminum component and a silicon component.

10. The one-piece golf ball according to claim 9, wherein said aluminum component and silicon component are deposited as an oxide or hydrate thereof on the surface of the titanium oxide particle.

11. The one-piece golf ball according to claim 6, wherein said coat further comprises an additive selected from the group consisting of an organic UV absorber, an oxidation inhibitor, a light stabilizer, a fluorescent whitening agent, a blocking inhibitor and a pigment.

12. The one-piece golf ball according to claim 6, wherein the coat is a clear coat substantially free of a pigment.

13. A one-piece golf ball comprising a golf ball body made of a rubber composition, and a coat for coating the golf ball body, the rubber composition containing 0.5 to 10 parts by mass of a titanium oxide relative to 100 parts by mass of a rubber component, the titanium oxide being surface-treated with a treating agent containing a zirconium component and one or more components including at least one element selected from the group consisting of aluminum, silicon, zinc, tin, antimony, and cerium, the coat containing a resin component including a urethane resin, and the coat being made of a multilayer.

* * * * *